United States Patent [19]

Neat

[11] 4,453,647

[45] Jun. 12, 1984

[54] PLASTIC CONTAINER HAVING THREADED CLOSURE

[76] Inventor: Benjamin C. Neat, 11201 Easum Rd., Jefferson Town, Ky. 40299

[21] Appl. No.: 461,243

[22] Filed: Jan. 26, 1983

[51] Int. Cl.[3] ..... B65D 41/04

[52] U.S. Cl. ..... 220/288; 220/306

[58] Field of Search ..... 220/288, 304, 306; 150/0.5

[56] References Cited

U.S. PATENT DOCUMENTS

| | | | |
|---|---|---|---|
| 3,998,355 | 12/1976 | Galer | 220/304 |
| 4,126,246 | 11/1978 | Galer | 220/304 |
| 4,245,753 | 1/1981 | Ellis | 220/288 |
| 4,245,754 | 1/1982 | Ellis | 220/288 |
| 4,380,304 | 4/1983 | Anderson | 220/306 |
| 4,399,926 | 8/1983 | Dubovoy | 220/288 |

*Primary Examiner*—George T. Hall

*Attorney, Agent, or Firm*—Brooks & Kushman

[57] ABSTRACT

A container (20) disclosed includes a receptacle (22) and a cover (24) each of which includes a unitary member (26,28) molded from plastic. A helical thread (44) on the upper end of the receptacle side wall (30) and a helical thread (58) on a downwardly projecting lip (50) of the cover are engaged with each other in mating relationship by either threading of the cover onto the receptacle or by downward movement as the receptacle side wall and the cover lip flex to permit such engagement by a snap action. A retainer (46) on the receptacle side wall receives the lower edge (52) of the cover lip and a retainer (60) on the cover receives the upper edge (36) of the receptacle side wall so as to maintain the mating relationship of the threads with the cover in its closed position. The container has particular utility for use as a paint container especially when utilized with specific constructional features disclosed.

28 Claims, 19 Drawing Figures

PLASTIC CONTAINER HAVING THREADED CLOSURE

TECHNICAL FIELD

This invention relates generally to a container that has particular utility for holding paint, stain or the like and, as such, will be described in connection with such usage with the understanding that the container has other usages such as for storing food or other contents.

BACKGROUND ART

Prior art plastic containers have included a unitary receptacle and a unitary cover that are secured to each other to close the container. Securement constructions previously utilized to securely hold the cover on the receptacle upon the initial sale of the container filled with its contents have not permitted easy opening and closing while still maintaining the cover securely closed on the receptacle.

Paint, varnish, stain and the like are conventionally sold at the retail level in metal cans which have an upper edge with a groove in which an annular edge of a metal cover is secured by a press fit. Opening of the cover is performed by prying the cover edge upwardly out of engagement with the can edge so that the stored contents can be used. Such metal cans are conventionally made from tin plated steel which has become more and more expensive in the recent past. Also, the ever increasing use of water-based latex paint with steel cans has necessitated the use of a special coating on the interior of the can in order to prevent the water from causing corrosion as the paint is stored. Another problem with metal paint cans is that they tend to dent when struck or dropped.

One prior attempt at making paint cans from other than metal utilized injection or blow molding of polypropylene plastic in order to overcome the corrosion problem when water-based latex paints are stored. This can require a molded bead on the inner surface at the upper end of the can in order to secure an associated cover with the required strength necessary to pass drop tests paint cans are subjected to before being accepted commercially by paint manufacturers.

U.S. Pat. Nos. 3.998,355 and 4,126,246 disclose plastic lids and pails which are secured to each other by engagement threads each of which extends about one-quarter of the circumference of the lid or pail. The size of the pails disclosed is relatively large, on the order of that required to hold five gallons of liquid or so. To date, this type of container has not found any widespread commercial acceptance as a paint container in the retail market. This lack of acceptance is probably a result of the fact that the pail wall thickness and cover wall thickness necessary to maintain engagement of the threads is so great as to make the construction impractical for paint containers which are normally sold as the retail level in a one gallon size or smaller. Also, the cover can only be secured to the pail by threading due to the cover, receptacle and thread construction involved.

U.S. Pat. Nos. 4,245,753 and 4,245,754 disclose plastic containers for paint wherein segmented buttress retainers secure a cover to a receptacle for storage while permitting removal of the cover upon rotation and subsequent upward movement. With this type of construction, the locations between the buttress retainers result in a spaced relationship between a side wall of the receptacle and an annular lip of the cover on which the segmented buttress retainers are supported. Such spacing between the receptacle side wall and the cover lip allows deflection therebetween in a manner that can disengage the buttress retainers such that opening of the cover can result in certain instances when the container is dropped.

DISCLOSURE OF INVENTION

An object of the present invention is provide an improved plastic container having a receptacle and a cover which can be securely attached to each other by either threading rotation of the cover or downward cover movement onto the receptacle and which can also be easily detached by unthreading rotation of the cover.

In carrying out the above object, the container constructed in accordance with the invention includes a receptacle and a cover each of which includes a unitary member molded from a suitable plastic such as high density polyethylene or polypropylene. The receptacle member includes a round side wall and a bottom wall, with the side wall including an upper end having a round upper edge that defines an open end of the receptacle, and with the side wall including a lower end that is closed by the bottom wall to define a closed end of the receptacle. The upper end of the side wall has round inner and outer surfaces one of which includes a helical thread. The cover member includes an upper wall and an annular lip that extends downwardly from the upper wall and has a round lower edge. Round inner and outer surfaces are provided on the cover lip with one of such surfaces including a helical thread for mating with the helical thread of the receptacle to secure the cover on the receptacle. Movement of the helical threads into mating engagement with each other is provided by threading upon relative rotation of the cover and the receptacle or by flexing of the receptacle side wall and the cover lip upon downward movement of the cover over the receptacle. A retainer is provided located on one of the members in a spaced and opposed relationship to the round surface thereof on which the helical thread thereof is mounted. This retainer opens vertically to receive the round edge of the other member upon securement of the cover to prevent lateral movement between the upper end of the receptacle side wall and the cover lip in order to maintain engagement of the helical threads.

With one construction of the container, the upper end of the receptacle side wall has a smaller size than the cover lip so as to be received thereby upon downward cover movement over the receptacle. The helical thread of the receptacle side wall is located on its outer surface, while the helical thread of the cover lip is located on its inner surface such that the helical threads mate as the cover is secured to the receptacle by either threading rotation or downward movement.

In another construction, the upper end of the receptacle side wall has a larger size than the cover lip so as to receive the cover lip upon downward cover movement over the receptacle. The helical thread of the receptacle side wall is located on its inner surface, while the helical thread of the cover lip is located on its outer surface such that the helical threads mate as the cover is secured to the receptacle by either threading rotation or downward movement of the cover.

Increased securement of the cover to the receptacle is achieved by incorporating a second retainer for maintaining the engagement of the helical threads in cooperation with the first retainer which is located on the one member of the container. The second retainer is located on the other member in a spaced and opposed relationship to the round surface thereof on which the helical thread thereof is located. The second retainer opens vertically to receive the round edge of the one member upon securement of the cover. The two retainers cooperate to prevent lateral movement between the upper end of the receptacle side wall and the cover lip in order to maintain the engagement of the helical threads and securement of the cover on the receptacle. Each of the retainers on each member preferably has a continuous construction for receiving and engaging the entire associated round edge of the other member.

Different constructions of the helical threads can be utilized. In one construction, the helical threads of the receptacle side wall and the cover lip include inclined surfaces that engage each other in an interlocking relationship when the cover is secured to the receptacle. In another construction, the helical threads of the receptacle side wall and the cover lip include vertically projecting lugs that engage each other in an interlocking relationship when the cover is secured to the receptacle.

The container is also disclosed as having only a single retainer for maintaining the engagement of the helical threads. In one such embodiment, the container includes a single retainer located on the receptacle side wall to receive the lower edge of the cover lip in order to maintain the engagement of the helical threads. In another such embodiment, the container includes a single retainer located on the cover to receive the upper edge of the receptacle side wall in order to maintain the engagement of the helical threads.

In the preferred construction of the container, the upper edge of the receptacle side wall and the cover include annular sealing surfaces that engage each other upon securement of the cover to seal the container without the necessity of any additional sealing component. The sealing surfaces are preferably smoother than the helical threads which are textured to facilitate unthreading of the cover while still permitting the container to be effectively sealed at the sealing surfaces.

In the preferred seal construction, the sealing surface on the upper edge of the receptacle side wall is laterally deflectable and the sealing surface on the cover is inclined. Engagement of the inclined sealing surface on the cover with the receptacle sealing surface laterally deflects the receptacle sealing surface as the cover is secured to the receptacle in order to provide sealing of the container. The upper edge of the receptacle side wall is disclosed as having a tapered configuration adjacent its sealing surface in order to permit the lateral deflection thereof upon securement of the cover and sealing of the container. The sealing surface of the cover preferably has a curved shape and the inclination thereof is oriented so as to extend inwardly in an upward direction in order to deflect the tapered upper edge of the receptacle side wall inwardly as the cover is secured to the receptacle.

In another seal construction of the container, the upper edge of the receptacle side wall includes spaced inner and outer sealing portions that define a pair of sealing surfaces. These receptacle surfaces are deflected toward each other upon engaging the sealing surface of the cover as the cover is secured to the receptacle by the helical threads.

In a further seal construction, the sealing surface of the cover has an inverted U-shaped configuration and the sealing surface on the upper edge of the receptacle side wall has a blunt shape. Engagement of the blunt sealing surface on the receptacle side wall with the inverted U-shaped sealing surface on the cover expands the cover sealing surface as the cover is secured to the receptacle in a sealed relationship.

Additional features are also provided on the container to facilitate its use for holding paint, stain, or the like. Both the receptacle and the cover are provided with indicators for indicating when the helical threads are fully engaged so as to be sure of the cover securement in order to prevent spillage of the contents. The cover is also provided with a removable plug for permitting a tinting agent to be injected into the filled container. A formation is also provided on the cover for permitting unthreading of the cover from the receptacle with the aid of a mixing stick or the like. This formation and the mixing stick can also be utilized to thread the cover onto the receptacle. Furthermore, the receptacle includes a handle molded unitary therewith and having a central handle section and supports extending from the handle section in opposite directions to the upper end of the receptacle side wall at diametrically opposite locations.

The objects, features, and advantages of the present invention are readily apparent on the following detailed description of the best modes for carrying out the invention when taken in connection with the accompanying drawings.

BEST MODES FOR CARRYING OUT THE INVENTION

Figure 1:
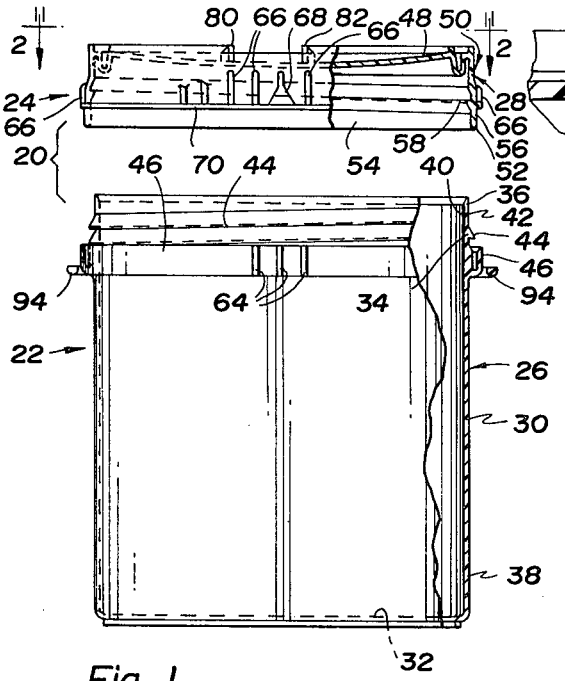
FIG. 1 is a partially broken away side elevation view of a container construction in accordance with the present invention and shown with a cover thereof positioned over a receptacle of the container in preparation for closing upon downward movement.

With reference to FIG. 1 of the drawings, a container generally indicated by 20 is constructed in accordance with the present invention and has particular utility when utilized as a contaier for paint, varnish, stain or the like although it is to be understood that the container can also be utilized to store other contents such as food, etc. Container 20 includes a receptacle 22 and a cover 24 which are embodied by associated unitary receptacle and cover members 26 and 28. A suitable semirigid plastic such as high density polyethylene or polypropylene is preferably utilized to injection mold the receptacle and cover members 26 and 28 to provide a construction that permits secure interlocking of the cover and receptacle as is hereinafter more fully described. As illustrated, the container is designed to be of the one gallon size and has a height just slightly less than 8 inches and a diameter of about 6 and one half inches. However, it should be understood that the container also has applicability to smaller sizes such as the quart or the pint size as well as to larger sizes even though the design does have particular utility with the one gallon size shown.

Figure 3:
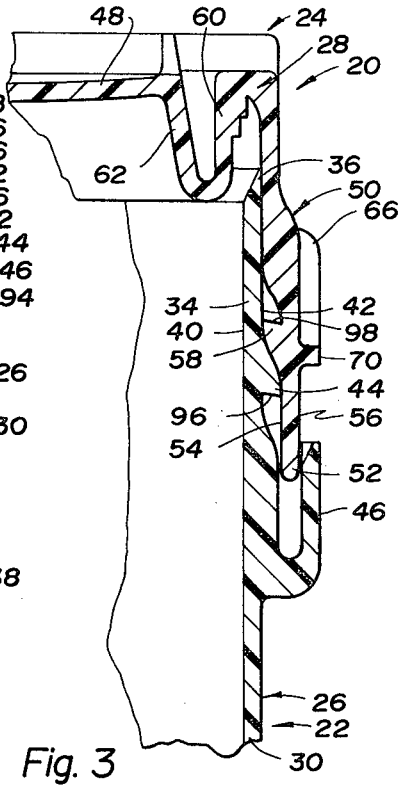
FIG. 3 is sectional view taken through the container along the direction of line 3—3 in FIG. 2 and showing the cover after downward movement from the position of FIG. 1 but prior to movement to its fully closed position.

With continuing reference to FIG. 1, the receptacle 22 is illustrated as including a round side wall 30 and a bottom wall 32 that cooperatively define an upwardly opening shape. Side wall 30 of the receptacle includes an upper end 34 having an upper edge 36 that defines an open end of the receptacle. Side wall 30 also includes a lower end 38 that is closed by the bottom wall 32 to define a closed end of the receptacle. Upper end 34 of the side wall 30 has round inner and outer surfaces 40 and 42 with a helical thread 44 provided on the outer surface. As also seen in FIG. 3, a retainer 46 is located on the receptacle side wall in a spaced and opposed relationship to the round outer surface thereof on which its helical thread 44 is located. As is hereinafter more fully described, retainer 46 functions to maintain a secured relationship of the cover 24 on receptacle 22 after closing of the cover.

Figure 2:
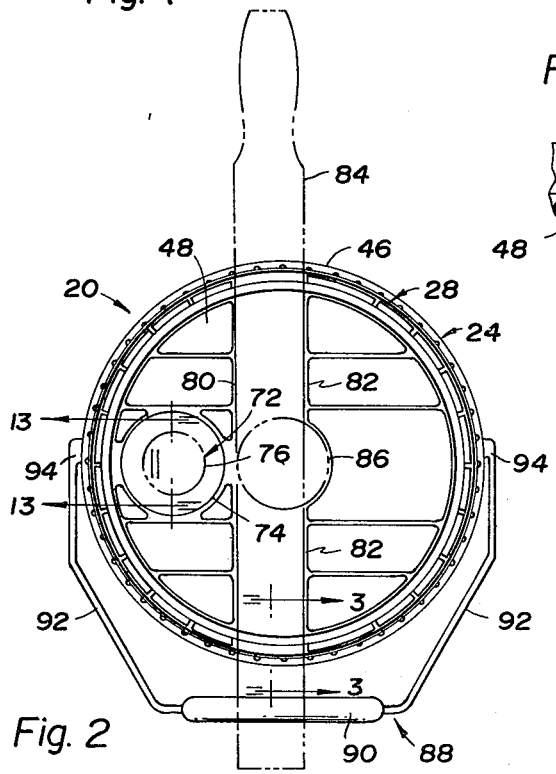
FIG. 2 is a top plan view of the container taken along the direction of line 2—2 in FIG. 1.

With combined reference to FIGS. 1, 2, and 3, the unitary cover member 28 includes an upper wall 48 and an annular lip 50 that extends downwardly from the upper wall and has a round lower edge 52. The cover lip 50 has round inner and outer surfaces 54 and 56 with a helical thread 58 provided on its inner surface for mating with the helical thread 44 of the receptacle 22 to secure the cover 24 to the receptacle. A retainer 60 is located on the cover member 28 in a spaced and opposed relationship to the round inner surface thereof and opens vertically in a downward direction to cooperate with the receptacle retainer 46 in securing the cover to the receptacle.

Cover 24 is movable from the open position of FIG. 1 to the partially closed position of FIG. 3 during closing of the container. From FIG. 3, the cover 24 can be moved to its fully closed position of FIG. 4 on the receptacle in one of two ways in order to move the helical threads 44 and 58 into mating engagement with each other. One method of closing is provided by rotating the cover 24 with respect to the receptacle 22 to engage the threads 44 and 58 with each other. Another method of cover closing is provided by downward cover movement that flexes the receptacle side wall 30 and the cover lip 50 to provide a snap action mating engagement of the helical threads 44 and 58. Upon closing by either method, the receptacle retainer 46 receives the lower round edge 52 of the cover lip 50 and the cover retainer 60 receives the upper round edge 36 of the receptacle side wall. Retainers 46 and 60 prevent lateral movement between the upper end 34 of the receptacle side wall and the cover lip 50 in order to maintain engagement of the helical threads 44 and 58 and thereby maintain the cover 24 secured to the receptacle 22.

Container 20 illustrated in FIGS. 1 through 4 is shown with a receptacle side wall 30 of a cylindrical shape as is normally utilized with paint pails. However, it is also possible to provide the receptacle side wall with a tapered shape having a smaller closed end and a larger open end so that the empty receptacles can be stacked for compact shipment and storage. Also, the upper end 40 of the receptacle side wall is illustrated with a smaller size than the annular lip 50 of the cover so as to be received thereby upon downward cover movement over the receptacle. As previously mentioned, the helical thread 44 and the retainer 46 of the receptacle side wall are located on the outer surface 42 of the side wall so as to project outwardly from the receptacle. In addition, the helical thread 58 and the retainer 60 of the cover are located within the inner surface 54 of the cover lip 50 so as to provide the mating of the helical threads and the securement of the receptacle and cover edges by the retainers as the cover is closed and secured to the receptacle. Also, cover retainer 60 is connected to the upper cover wall 48 by an annular ring 62. Deflection of the retainer 60 and the ring 62 in a bellows-like fashion permits upward movement of the cover wall 48 to accommodate for any pressure increase that may take place within the container such as due to an increase in temperature from one season to the next.

Different embodiments of the container which are similar to the previously described embodiment are shown in FIGS. 5 through 12 and identified with like reference numerals referring to like components. Except as will be noted, much of the previous description of the container embodiment of FIGS. 1 through 4 is applicable to the embodiments of FIGS. 5 through 12 and thus need not be repeated. Also, the description of the additional container embodiments is followed by a description of further features of the container which can be utilized with any one of the container embodiments.

Figure 4:
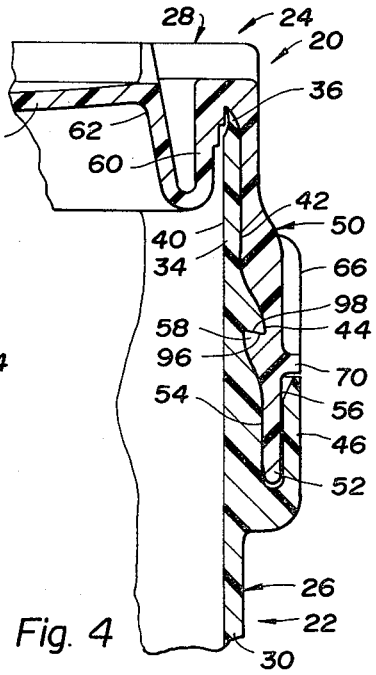
FIG. 4 is a sectional view similar to FIG. 3 but showing the cover after movement thereof to its fully closed position.
Figure 5:
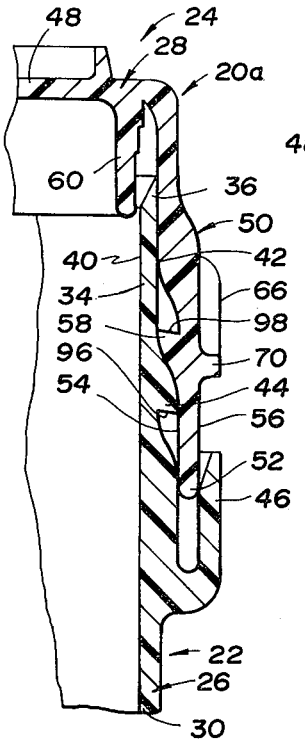
FIGS. 5 and 6 are views similar to FIGS. 3 and 4 but illustrating another embodiment of the container.
Figure 6:
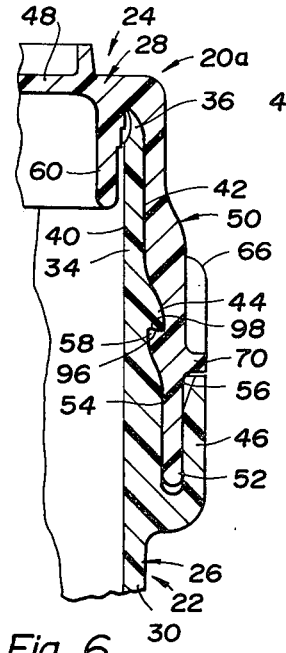

Container 20*a* illustrated in FIGS. 5 and 6 is identical to the container 20 illustrated in FIGS. 3 and 4 except for its cover retainer 60 which extends downwardly directly from the upper wall 48 of the cover member 28 just inboard from the cover lip 50. Otherwise, containers 20 and 20*a* have the identical construction as each other and the previous description is applicable to both containers.

Figure 7:
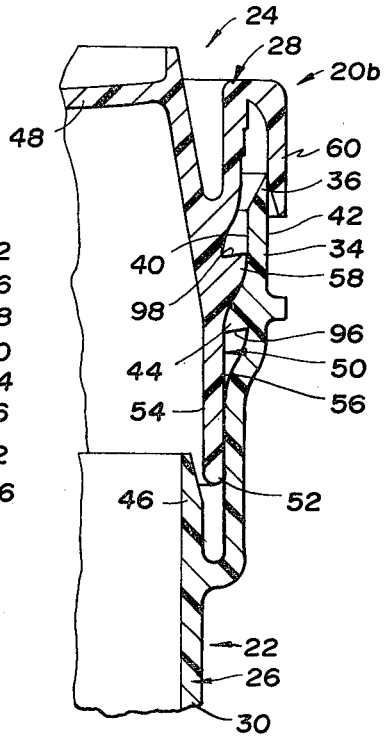
FIGS. 7 and 8 are also views similar to FIGS. 3 and 4 but illustrating another embodiment of the container.
Figure 8:
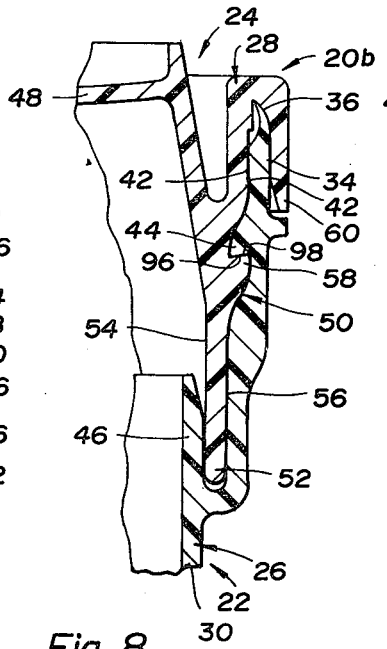

Container 20*b* illustrated in FIGS. 7 and 8 includes a receptacle 22 whose side wall 30 has an upper end 34 of a larger size than the cover lip 50 so as to receive the cover lip upon downward movement of the cover 24 over the receptacle 22. The helical thread 44 of the receptacle side wall 30 is located on its inner surface 40 as is the receptacle retainer 46. The helical thread 58 of the cover lip 50 is located on its outer surface 56 as is the cover retainer 60. During closing of the cover, the helical threads 44 and 58 are moved into mating engagement as the receptacle and cover retainers 46 and 60 respectively receive the cover and side wall edges 52 and 36 to maintain the thread engagement and the cover securement.

Figure 9:
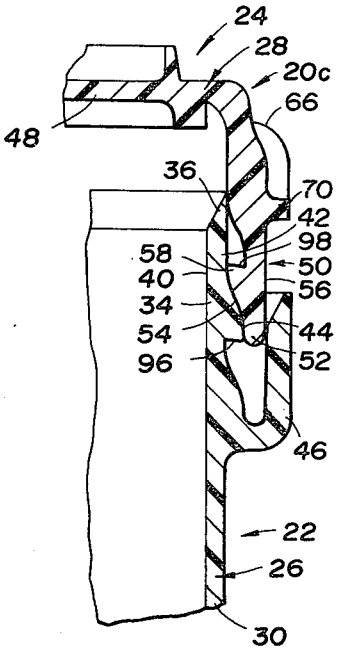
FIGS. 9 and 10 are also views similar to FIGS. 3 and 4 but illustrating another embodiment of the container.
Figure 10:
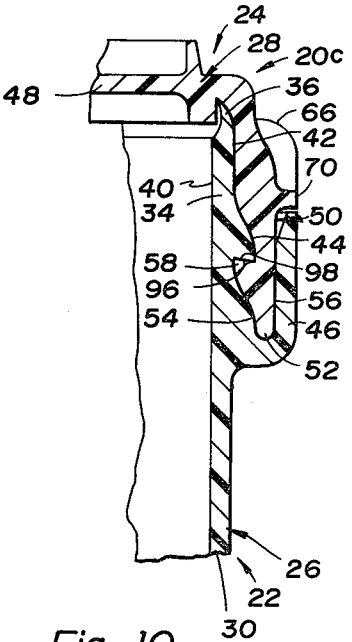

Container 20*c* illustrated in FIGS. 9 and 10 has the same construction as the container 20*a* illustrated in FIGS. 5 and 6 but includes only a single retainer 46 on the receptacle side wall 30 for receiving the lower edge 52 of the cover lip 50 as the cover is secured to the receptacle. Thus, the upper edge 36 of the receptacle side wall is not retained against lateral movement in the secured position of FIG. 10 with this embodiment. Rather, the mating engagement of the receptacle and cover threads 44 and 58 is maintained by the single receptacle retainer 46 in order to maintain the securement of the cover.

Figure 11:
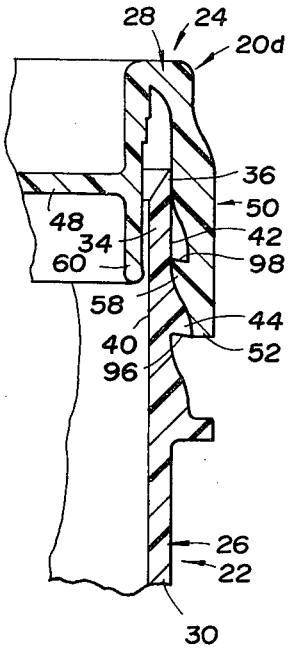
FIGS. 11 and 12 are also views similar to FIGS. 3 and 4 but illustrating another embodiment of the container.
Figure 12:
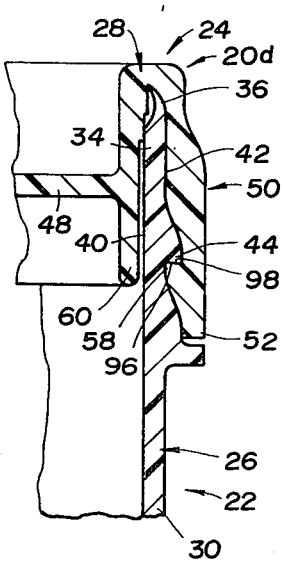

Container 20*d* illustrated in FIGS. 11 and 12 includes a single retainer 60 on the cover 24 for receiving the upper edge 36 of the receptacle side wall during closing of the cover. This cover retainer 60 extends downwardly from the upper wall 48 of the cover like the cover retainer 60 illustrated in FIGS. 5 and 6, but the cover wall 48 is illustrated as being at a somewhat lower elevation than in the other embodiment. Upon closing of the cover, the mating engagement of the receptacle and cover threads 44 and 58 is thus maintained solely by the cover retainer 60.

It should be noted that the container embodiments 20 and 20*a* illustrated in FIGS. 3 and 4 and in FIGS. 5 and 6 are the most preferred constructions since the receptacles thereof can be completely filled and the use of both a receptacle and a cover retainer provides increased securement of the cover against unintended opening. Likewise, when utilized for a paint container, excess paint wiped off on the upper receptacle edge 36 will not coat the helical thread 44 of the cover. In certain applications, the embodiment 20*b* of FIGS. 7 and 8 may also function effectively such as with bulk paint cans that are not completely filled or with other containers whose contents will not adversely affect the mating thread engagement upon repeated cover opening and closing. Furthermore, the containers 20*c* and 20*d* illustrated in FIGS. 9 and 10 and FIGS. 11 and 12 can function effectively when the receptacle and cover can be made sufficiently rigid to insure the engagement of the receptacle and cover threads with only a single retainer as previously described.

All of the containers illustrated in FIGS. 1 through 12 preferably have the receptacle 22 and cover 24 each provided with a single helical thread 44 and 58, respectively, that extends about the container for more than 360 degrees. Specifically, the receptacle thread 44 in the preferred construction shown extends about the receptacle for about $1\frac{3}{4}$ turns, while the cover thread 58 extends around the cover for about $1\frac{1}{4}$ turns. Upon cover securement by the downward cover movement that flexes the upper end 34 of the receptacle side wall and the cover lip 50, the leading ends of the threads just miss each other such that the cover is secured by just slightly less than one full turn of fully engaged threads. It is also possible for the cover to then be rotated a slight extent to more fully engage the threads for slightly more than one full revolution. This thread construction allows the threads to have a less steep inclination than is necessary with partial threads positoned circumferentially with respect to each other about the circumference of the container.

It is also preferable for the receptacle retainer 46 and the cover retainer 60 to extend continuously around the container in an annular shape in order to prevent the receptacle side wall and cover lip deflection that could result in thread disengagement that produces cover detachment. However, it is possible for the receptacle retainer 46 of each embodiment to be discontinuous. Likewise, the cover retainer 60 of FIGS. 5 and 6, 7 and 8, and 11 and 12 can also be discontinuous and still function even though it is preferred to have the continuous shape discussed.

As illustrated in FIG. 1, the receptacle 22 includes three rib indicators 64 spaced circumferentially on the outer surface of its retainer 46. Cover 24 includes vertically extending ribs 66 spaced circumferentially about the outer surface of its annular lip 50 and also includes a triangular indicator 68. The positioning of the helical threads 44 and 58 on the receptacle and cover is such that the full mating engagement thereof is provided when the indicator 68 on the cover is located between the two extreme indicators 64 on the receptacle. Also, the lower ends of the ribs 66 and the indicator 68 on the cover are connected by an annular ring 70 which can engage the cover retainer 46 to limit the threading engagement or can be spaced upwardly therefrom a slight extent while still providing protection against intrusion of most foreign particles into the upwardly opening receptacle retainer.

Figure 13:
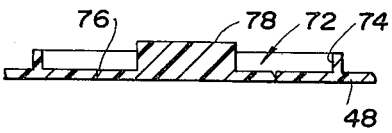
FIG. 13 is a sectional view taken through the cover along the direction of line 13—13 in FIG. 2 to illustrate a removable plug that permits injection of a tinting agent into the closed container.

With reference to FIGS. 2 and 13, the upper wall 48 of the cover member 28 includes a tinting plug that is generally indicated by 72 and located within an annular rib 74 which projects upwardly from the upper wall of the cover. An annular groove 76 in the cover wall 48 at the periphery of the tinting plug 72 permits removal thereof upon being manually grasp by a tab 78. After such removal, a tinting agent can be injected into the container to tint paint contents thereof and the hole in the upper wall 48 is then filled by a conventional replacement plug of the type normally used with metal paint cans.

With reference to FIGS. 1 and 2, the cover 24 also includes a pair of straight ribs 80 and 82 that project upwardly from its upper wall 48 and define a channel formation for receiving a paint stick 84 or the like that can be utilized to tighten or release the helical threads that secure the cover to the receptacle. Rib 82 has a central circular portion 86 that can be utilized to index the cover when utilized with automated filling equipment. Similarly, the indicators 64 of the receptacle 22 as illustrated in FIG. 1 can also be utilized to provide indexing of the receptacle upon filling with such automated equipment.

As best seen in FIG. 2, the receptacle 22 includes a handle 88 molded unitary therewith and having a central handle section 90 for carrying the container. Handle supports 92 extend in opposite directions from the handle section 90 to the upper end of the receptacle side wall at diametrically opposite locations where lugs 94 are connected to the upper end of the side wall. Preferably, the handle 88 is molded extending in a horizontal direction parallel to the plane defined by the upper edge 36 of the receptacle side wall. When the container is picked up by the handle section 90, the handle supports 92 flex at the lugs 94 to permit carrying in a downwardly depending fashion.

In each of the container embodiments illustrated in FIGS. 3 through 12, the helical threads 44 and 58 on the receptacle and the cover include inclined surfaces 96 and 98, respectively, that engage each other in the fully closed position of the cover. This engagement of the inclined surfaces 96 and 98 provides an interlocking relationship between the upper end of the receptacle side wall 30 and the annular lip 50 of the cover so as to cooperate with the receptacle and cover retainers in preventing lateral movement therebetween when the cover is secured to the receptacle in the closed position. Good results have been found to result when the surfaces 96 and 98 are inclined at about 10 degrees to the horizontal.

Figure 14:
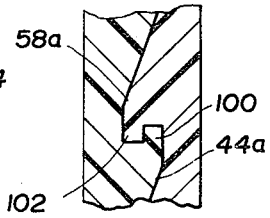
FIG. 14 is a partial view taken in the same direction as FIGS. 3 through 12 but illustrating another embodiment of helical threads used to secure the cover to the receptacle.

Each of the container embodiments illustrated in FIGS. 3 through 12 can also be made with an alternate construction of the helical threads as shown in FIG. 14. The helical threads **44*a* and 58*a* of the receptacle side wall and the cover lip in this alternate construction include associated vertically projecting lugs 100 and 102 that engage each other in an interlocking relationship when the cover is secured to the receptacle in its closed position. Such engagement of the thread lugs 100 and 102** cooperates with the receptacle and cover retainers previously described to prevent lateral movement therebetween and thereby further maintains the engagement of the threads to secure the cover in its closed position.

Figure 15:
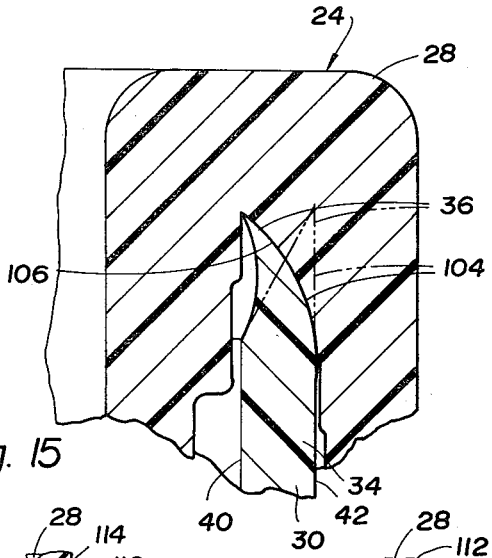
FIG. 15 is an enlarged view illustrating the seal construction of the container embodiments disclosed by FIGS. 3 through 12.

With reference to FIG. 15, the most preferred construction for sealing the container is illustrated as including a sealing surface 104 on the upper edge 36 of the receptacle side wall 30 and as also including a sealing surface 106 on the cover member 28. These sealing surfaces 104 and 106 are molded so as to be smoother than the helical threads which are provided with a suitable texturing that reduces the friction between the threads. Such a construction facilitates threading and unthreading of the cover while still permitting the container to be effectively sealed by the sealed engagement at the sealing surfaces 104 and 106 without the necessity of any additional sealing component.

With continued reference to FIG. 15, the sealing surface 104 on the upper edge 36 of the receptacle side wall 30 is laterally deflectable as illustrated by its phantom and solid line positions. The sealing surface 106 on the cover 24 is inclined so as to laterally deflect the sealing surface 104 on the upper edge of the receptacle side wall as the cover is secured to the receptacle. During such securement, the upper edge 36 of the receptacle side wall is deflected by the inclined sealing surface 106 such that its sealing surface 104 moves from the phantom line indicated position to the solid line indicated position shown. In the preferred construction, the upper edge 36 of the receptacle side wall tapers from its inner surface 40 to its outer surface 42. The inclined sealing surface 106 on the cover preferably has a curved shape and extends inwardly toward the center of the cover in an upward direction so as to deflect the tapered upper edge 36 of the receptacle side wall inwardly as the cover is secured to the receptacle.

Figure 16:
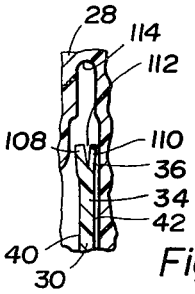
FIGS. 16 and 17 are partial views similar to FIGS. 3 through 12 illustrating another construction for sealing the container.
Figure 17:
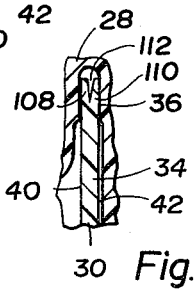

Another seal construction is illustrated in FIGS. 16 and 17 which respectively correspond to partially closed and fully closed positions of the cover on the receptacle. In this seal construction, the upper edge 36 of the receptacle side wall 30 includes inner and outer annular sealing portions 108 and 110 that are separated by an annular groove 112. The cover member 28 defines an annular groove 114 of a width slightly less than the spacing between the sealing portions 108 and 110. As such, upon closing, the sealing portions 108 and 110 are deflected toward each other upon movement from the position of FIG. 16 to the position of FIG. 17. Outer surfaces on the sealing portions 108 and 110 and the sides of the groove 114 are smoother than the textured helical threads so as to facilitate such closing while still permitting effective sealing and easy opening of the cover in the manner previously described in connection with tapered seal construction.

Figure 18:
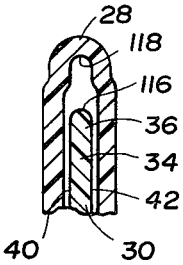
FIGS. 18 and 19 are also partial views similar to FIGS. 3 and 12 and illustrate still another construction for sealing the container.
Figure 19:
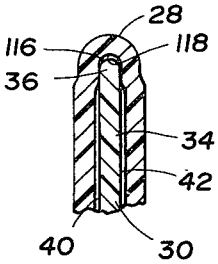

A further seal construction is illustrated in FIGS. 18 and 19 which respectively illustrate partially and fully closed positions of the cover on the receptacle. In this seal construction, the upper edge 36 of the receptacle side wall 30 has a blunt shape which preferably is of a rounded shape as illustrated at 116. Cover 24 includes a groove 118 that receives the blunt upper edge 36 of the receptacle side wall upon closing of the cover. The side surfaces of groove 118 are spaced just slightly closer to each other than the thickness of the upper edge 36 of the receptacle side wall such that a slight flexing of the groove 118 takes place as the cover is fully closed to provide sealing. Both the side surfaces of the upper cover edge 36 and the side surfaces of the groove 118 are smoother than the helical threads of the receptacle and the cover to facilitate cover opening and closing as previously described.

While the best modes for carrying out the invention have been described in detail, those familiar with the art to which this invention relates will recognize various alternative designs and embodiments for practicing the invention as defined by the following claims.

What is claimed is:

1. A container comprising: a receptacle and a cover each of which includes a unitary member molded from plastic; said receptacle member including a round side wall and a bottom wall; said side wall including an upper end having a round upper edge that defines an open end of the receptacle; the side wall also including a lower end that is closed by the bottom wall to define a closed end of the receptacle; the upper end of the side wall having round inner and outer surfaces one of which includes a helical thread; said cover member including an upper wall and an annular lip that extends downwardly from the upper wall and has a round lower edge; said cover lip having round inner and outer surfaces one of which includes a helical thread for mating with the helical thread of the receptacle to secure the cover on the receptacle; said helical threads being movable into mating engagement with each other by threading upon relative rotation between the cover and the receptacle or by flexing of the receptacle side wall and the cover lip upon downward movement of the cover over the receptacle; a retainer located on one of the members in a spaced and opposed relationship to the round surface thereof on which the helical thread thereof is mounted; and said retainer opening vertically to receive the round edge of the other member upon securement of the cover to prevent lateral movement between the upper end of the receptacle side wall and the cover lip in order to maintain engagement of the helical threads.

2. A container as in claim 1 wherein the upper end of the receptacle side wall has a smaller size than the cover lip so as to be received thereby upon downward cover movement over the receptacle, the helical thread of the receptacle side wall being located on the outer surface thereof, and the helical thread of the cover lip being located on the inner surface thereof such that the helical threads mate as the cover is secured to the receptacle.

3. A container as in claim 1 wherein the upper end of the receptacle side wall has a larger size than the cover lip so as to receive the cover lip upon downward cover movement over the receptacle, the helical thread of the receptacle side wall being located on the inner surface thereof, and the helical thread of the cover lip being located on the outer surface thereof such that the helical threads mate as the cover is secured to the receptacle.

4. A container as in claim 2 or 3 which includes a second retainer mounted on the other member in a spaced and opposed relationship to the round surface thereof on which the helical thread thereof is located, and said second retainer opening vertically to receive the round edge of the one member upon securement of the cover such that the retainers cooperate to prevent lateral movement between the upper end of the receptacle side wall and the cover lip in order to maintain engagement of the helical threads and securement of the cover on the receptacle.

5. A container as in claim 4 wherein each retainer on each member has a continuous construction for receiving and engaging the entire associated round edge of the other member.

6. A container as in claim 1, 2, or 3 wherein the helical threads of the receptacle side wall and of the cover lip include inclined surfaces that engage each other in an interlocking relationship when the cover is secured to the receptacle.

7. A container as in claim 1, 2, or 3 wherein the helical threads of the receptacle side wall and the cover lip include vertically projecting lugs that engage each other in an interlocking relationship when the cover is secured to the receptacle.

8. A container as in claim 1 which includes a single retainer located on the receptacle side wall to receive the lower edge of the cover lip.

9. A container as in claim 1 which includes a single retainer located on the cover to receive the upper edge of the receptacle side wall.

10. A container as in claim 1 wherein the upper edge of the receptacle side wall and the cover include sealing surfaces that engage each other upon securement of the cover to seal the container.

11. A container as in claim 10 wherein the sealing surfaces are smoother than the helical threads to facilitate unthreading of the cover while still permitting the container to be effectively sealed.

12. A container as in claim 10 or 11 wherein the sealing surface on the upper edge of the receptacle side wall is laterally deflectable, and the sealing surface on the cover being inclined so as to laterally deflect the sealing surface on the upper edge of the receptacle side wall as the cover is secured to the receptacle.

13. A container as in claim 12 wherein the upper edge of the receptacle side wall has a tapered configuration adjacent its sealing surface.

14. A container as in claim 13 wherein the inclined sealing surface of the cover has a curved shape.

15. A container as in claim 14 wherein the inclined sealing surface of the cover extends inwardly in an upward direction so as to deflect the tapered upper edge of the receptacle side wall inwardly as the cover is secured to the receptacle.

16. A container as in claim 10 or 11 wherein the upper edge of the receptacle side wall includes spaced inner and outer sealing portions that define a pair of the sealing surfaces which are deflected toward each other upon engaging the sealing surface of the cover as the cover is secured to the receptacle.

17. A container as in claim 10 or 11 wherein the sealing surface of the cover has an inverted U-shaped configuration, and the sealing surface on the upper edge of the receptacle side wall having a blunt shape that engages and expands the inverted U-shaped sealing surface on the cover as the cover is secured to the receptacle.

18. A container as in claim 1 wherein the receptacle and the cover include indicators for indicating when the helical threads are fully engaged.

19. A container as in claim 1 wherein the cover includes a removable plug for permitting a tinting agent to be injected into the filled container.

20. A container as in claim 1 wherein the cover includes a formation for permitting unthreading of the cover from the receptacle with the aid of a mixing stick or the like.

21. A container as in claim 1 wherein the receptacle includes a handle molded unitary therewith and having a central handle section and supports extending from the handle section in opposite directions to the upper end of the receptacle side wall at diametrically opposite locations.

22. A container comprising: a receptacle and a cover each of which includes a unitary member molded from plastic; said receptacle member including a round side wall and a bottom wall; said side wall including an upper end having a round upper edge that defines a sealing surface and an open end of the receptacle; the side wall also including a lower end that is closed by the bottom wall to define a closed end of the receptacle; the upper end of the side wall having round inner and outer surfaces; the round outer surface of the receptacle side wall having a helical thread; said cover member including an upper wall and an annular lip that extends downwardly from the upper wall and has a round lower edge; a sealing surface on the cover member located within the cover lip; said cover lip having round inner and outer surfaces; the round inner surface of the cover lip including a helical thread for mating with the helical thread of the receptacle to secure the cover on the receptacle; said helical threads being movable into mating engagement with each other by threading upon relative rotation between the cover and the receptacle or by flexing of the receptacle side wall and the cover lip upon downward movement of the cover over the receptacle; a retainer on the receptacle side wall in a spaced and opposed relationship to the round outer surface thereof; and said retainer opening upwardly to receive the round lower edge of the cover lip upon securement of the cover to prevent lateral movement between the upper end of the receptacle side wall and the cover lip in order to maintain engagement of the helical threads.

23. A container comprising: a receptacle and a cover each of which includes a unitary member molded from plastic; said receptacle member including a round side wall and a bottom wall; said side wall including an upper end having a round upper edge that defines a sealing surface and an open end of the receptacle; the side wall also including a lower end that is closed by the bottom wall to define a closed end of the receptacle; the upper end of the side wall having round inner and outer surfaces; the round outer surface of the receptacle side wall having a helical thread; said cover member including an upper wall and an annular lip that extends downwardly from the upper wall and has a round lower edge; a sealing surface on the cover member located within the cover lip; said cover lip having round inner and outer surfaces; the round inner surface of the cover lip including a helical thread for mating with the helical thread of the receptacle to secure the cover on the receptacle; said helical threads being movable into mating engagement with each other by threading upon relative rotation between the cover and the receptacle or by flexing of the receptacle side wall and the cover lip upon downward movement of the cover over the receptacle; a first retainer on the receptacle side wall in a spaced and opposed relationship to the round outer surface thereof; said first retainer opening upwardly to receive the round lower edge of the cover lip upon securement of the cover to prevent lateral movement between the upper end of the receptacle side wall and the cover lip in order to maintain engagement of the helical threads; and a second retainer on the cover opening downwardly to receive the round upper edge of the receptacle side wall to cooperate with the first retainer in preventing lateral movement between the upper end of the receptacle side wall and the cover lip in order to maintain engagement of the helical threads.

24. A container comprising: a receptacle and a cover each of which includes a unitary member molded from plastic; said receptacle member including a round side wall and a bottom wall; said side wall including an upper end having a round upper edge that defines a sealing surface and an open end of the receptacle; said upper edge of the receptacle side wall having a tapered shape such that the sealing surface thereon is laterally deflectable; the side wall also including a lower end that is closed by the bottom wall to define a closed end of the receptacle; the upper end of the side wall having round inner and outer surfaces; the round outer surface of the receptacle side wall having a helical thread; said receptacle member including a handle molded unitary therewith and having a central handle section and supports extending from the handle section in opposite directions to the upper end of the receptacle side wall at diametrically opposite locations; said cover member including an upper wall and an annular lip that extends downwardly from the upper wall and has a round lower edge; an inclined sealing surface on the cover member located within the cover lip; said cover lip having round inner and outer surfaces; the round inner surface of the cover lip including a helical thread for mating with the helical thread of the receptacle to secure the cover on the receptacle; said helical threads being movable into mating engagement with each other by threading upon relative rotation between the cover and the receptacle or by flexing of the receptacle side wall and the cover lip upon downward movement of the cover over the receptacle; the sealing surface on the upper edge of the receptacle side wall being laterally deflected by engagement thereof with the cover sealing surface upon securement of the cover; a first retainer extending continuously around the receptacle side wall in a spaced and opposed relationship to the round outer surface thereof; said first retainer opening upwardly to receive the round lower edge of the cover lip upon securement of the cover to prevent lateral movement between the upper end of the receptacle side wall and the cover lip in order to maintain engagement of the helical threads; and a second retainer extending continuously around the cover within the lip thereof so as to open downwardly to receive the round upper edge of the receptacle side wall to cooperate with the first retainer in preventing lateral movement between the upper end of the receptacle side wall and the cover lip in order to maintain engagement of the helical threads.

25. A container comprising: a receptacle and a cover each of which includes a unitary member molded from plastic; said receptacle member including a round side wall and a bottom wall; said side wall including an upper end having a round upper edge that defines a sealing surface and an open end of the receptacle; said upper edge of the receptacle side wall having a tapered shape that is laterally deflectable in an inward direction; the side wall also including a lower end that is closed by the bottom wall to define a closed end of the receptacle; the upper end of the side wall having round inner and outer surfaces; the round outer surface of the receptacle side wall having a helical thread; said receptacle member including a handle molded unitary therewith and having a central handle section and supports extending from the handle section in opposite directions to the upper end of the receptacle side wall at diametrically opposite locations; said cover member including an upper wall and an annular lip that extends downwardly from the upper wall and has a round lower edge; an inclined sealing surface on the cover member located within the cover lip; said cover lip having round inner and outer surfaces; the round inner surface of the cover lip including a helical thread for mating with the helical thread of the receptacle to secure the cover on the receptacle; said helical threads being movable into mating engagement with each other by threading upon relative rotation between the cover and the receptacle or by flexing of the receptacle side wall and the cover lip upon downward movement of the cover over the receptacle; the sealing surface on the upper edge of the receptacle side wall being laterally deflected in an inward direction by engagement thereof with the cover sealing surface upon securement of the cover; the sealing surfaces being smoother than the helical threads to facilitate unthreading of the cover while still permitting the container to be effectively sealed; a first retainer extending continuously around the receptacle side wall in a spaced and opposed relationship to the round outer surface thereof; said first retainer opening upwardly to receive the round lower edge of the cover lip upon securement of the cover to prevent lateral movement between the upper end of the receptacle side wall and the cover lip in order to maintain engagement of the helical threads; and a second retainer extending continuously around the cover within the lip thereof so as to open downwardly to receive the rund upper edge of the receptacle side wall to cooperate with the first retainer in preventing lateral movement between the upper end of the receptacle side wall and the cover lip in order to maintain engagement of the helical threads.

26. A container comprising: a receptacle and a cover each of which includes a unitary member molded from plastic; said receptacle member including a round side wall and a bottom wall; said side wall including an upper end having a round upper edge that defines an open end of the receptacle; the side wall also including a lower end that is closed by the bottom wall to define a closed end of the receptacle; the upper end of the side wall having round inner and outer surfaces one of which includes a helical thread; said cover member including an upper wall and an annular lip that extends downwardly from the upper wall and has a round lower edge; said cover lip having round inner and outer surfaces one of which includes a helical thread for mating with the helical thread of the receptacle to secure the cover on the receptacle; said helical threads being movable into mating engagement with each other by threading upon relative rotation between the cover and the receptacle or by flexing of the receptacle side wall and the cover lip upon downward movement of the cover over the receptacle; and the helical threads having constructions that interlock when an upward force is applied to the cover such that the threads prevent lateral movement of the receptacle side wall and the cover lip away from each other.

27. A container as in claim 26 wherein the helical threads include sloped surfaces that are inclined in a direction so as to provide the interlocking between the receptacle side wall and the cover lip.

28. A container as in claim 26 wherein the helical threads include vertically projecting lugs that provide the interlocking between between the receptacle side wall and the cover lip.

* * * * *